US005832993A

United States Patent [19]

Ohata et al.

[11] Patent Number: 5,832,993

[45] Date of Patent: Nov. 10, 1998

[54] HEAT-EXCHANGE ELEMENT

[75] Inventors: Naruo Ohata; Toru Saito; Kenji Odashima; Takashi Kawanishi, all of Fujisawa, Japan

[73] Assignee: Ebara Corporation, Tokyo, Japan

[21] Appl. No.: 773,376

[22] Filed: Dec. 26, 1996

[30] Foreign Application Priority Data

Dec. 28, 1995 [JP] Japan ..... 7-353284

[51] Int. Cl.[6] ..... F28F 3/08

[52] U.S. Cl. ..... 165/166; 165/DIG. 387; 165/DIG. 389

[58] Field of Search ..... 165/165, 166

[56] References Cited

U.S. PATENT DOCUMENTS

| | | | |
|---|---|---|---|
| 3,568,765 | 3/1971 | Konrad . | |
| 4,724,902 | 2/1988 | Gross . | |
| 4,858,685 | 8/1989 | Szucs et al. | 165/166 |
| 4,907,648 | 3/1990 | Emmerich et al. | 165/166 |
| 4,919,200 | 4/1990 | Glomski | 165/166 |
| 5,088,552 | 2/1992 | Raunio | 165/166 |

FOREIGN PATENT DOCUMENTS

| | | | |
|---|---|---|---|
| 3109955A1 | 3/1981 | Germany . | |
| 3844040A1 | 12/1988 | Germany . | |
| 63-194192 | 8/1988 | Japan | 165/166 |
| 3-286995 | 12/1991 | Japan . | |
| 4313693 | 11/1992 | Japan | 165/166 |
| 5-79784 | 3/1993 | Japan . | |
| 198215 | 9/1965 | Sweden | 165/166 |
| 838466 | 11/1957 | United Kingdom . | |
| 2253694 | 10/1992 | United Kingdom . | |
| WO 89/00671 | 1/1989 | WIPO . | |

*Primary Examiner*—Allen J. Flanigan
*Attorney, Agent, or Firm*—Armstrong, Westerman, Hattori, McLeland & Naughton

[57] ABSTRACT

A heat-exchange element has a plurality of heat-exchange components each having a circular heat-exchange plate. The circular heat-exchange plate has a plurality of ribs projecting from a surface thereof and extending generally in one direction. The outer circumferential edge of the circular heat-exchange plate is divided into four substantially equal edges. The circular heat-exchange plate includes a pair of sealing ribs extending respectively along two diametrically opposite ones of the edges substantially parallel to the ribs, and a pair of end walls extending respectively along two other diametrically opposite ones of the edges substantially transversely to the ribs. The heat-exchange components are stacked into a cylindrical shape in which the end walls of each of the circular heat-exchange plates fittingly engage the sealing ribs of another one of the circular heat-exchange plates.

3 Claims, 10 Drawing Sheets

HEAT-EXCHANGE ELEMENT

BACKGROUND OF THE INVENTION

1. Field of the Invention:

The present invention relates to a heat-exchange element for use in a heat-exchanger unit for transferring heat between supplied atmospheric air and discharged interior air while replacing the discharged interior air with the supplied atmospheric air thereby to reduce the burden on an air-conditioning unit that is used in combination with the heat-exchanger unit for saving the amount of energy required to operate the air-conditioning unit.

2. Description of the Prior Art:

FIGS. 1 through 3 of the accompanying drawings illustrate a conventional heat-exchange element for transferring heat between supplied atmospheric air and discharged interior air without allowing them to mix with each other. FIG. 4 shows the conventional heat-exchange element illustrated in FIG. 1 which is assembled in a heat-exchanger unit.

As shown in FIGS. 1 through 3, the conventional heat-exchange element, generally designated by 1 in FIG. 1, comprises a plurality of moisture-permeable rectangular heat-exchange plates 2 for carrying out a full heat exchange, and a plurality of corrugated fins 3 of flame-resistant paper, plastic, or the like which are bonded to respective surfaces of the heat-exchange plates 2. The heat-exchange plates 2 and the corrugated fins 3 bonded thereto jointly make up a plurality of stacked heat-exchange components 5 each analogous to a corrugated cardboard and having a plurality of fluid passages 4 of triangular cross section. The conventional heat-exchange element 1 also has four posts 6 of metal fitted in and fastened by screws to respective rails of a heat-exchanger unit on the respective four corners of the heat-exchange components 5 to seal the corners and keep the heat-exchange components 5 in a desired configuration. Adjacent ones of the heat-exchange components 5 are oriented alternately at right angles with respect to each other.

The conventional heat-exchange element 1 is manufactured by first stacking the heat-exchange components 5 and then cutting them to a desired shape. The heat-exchange plates 2 and the corrugated fins 3 have to be bonded firmly to each other for preventing air from mixing between the fluid passages 4.

As shown in FIG. 4, the conventional heat-exchange element 1 is assembled in a heat-exchanger unit which has an upper panel 7, a lower panel 8, and a partition 9 disposed intermediate between the upper and lower panels 7, 8. The upper and lower panels 7, 8 and the partition 9 jointly define upper and lower fluid passages 7A, 8A. The heat-exchange element 1 is positioned between the upper and lower panels 7, 8 across the partition 9 transversely to the upper and lower fluid passages 7A, 8A, then the heat-exchange element 1 changes the air flowing perpendicularly with the upper and lower fluid passages 7A, 8A. Exterior air flowing from the lower fluid passage 8A is introduced through the heat-exchange element 1 and the upper fluid passage 7A into a room, and interior air flows from the room through the lower fluid passage 8A into the heat-exchange element 1 and then through the upper fluid passage 7A into the atmosphere outside of the room.

The air introduced into the room and the air discharged from the room flow through the fluid passages 4, which extend perpendicular to each other, of the alternately stacked heat-exchange components 5. Heat is transferred between the air introduced into the room and the air discharged from the room while they are flowing through the fluid passages 4.

Japanese laid-open patent publication No. 5-79784 discloses another conventional heat-exchange element comprising a plurality of heat-exchange components alternating with a plurality of partitions. Each of the heat-exchange components comprises a rectangular heat-exchange plate having a plurality of ribs disposed on one surface thereof and a plurality of ribs disposed on the other surface thereof, and a pair of heat-exchange plates sandwiching the ribs on the opposite surfaces of the rectangular heat-exchange plate. The heat-exchange plates with the sandwiched ribs are integrally encased in a molded body of synthetic resin. The disclosed heat-exchange element is designed to reduce the resistance to the flow of air therethrough and also to lower the manufacturing cost thereof.

Each of the above conventional heat-exchange elements requires a relatively large installation space to be formed within the heat-exchanger unit in which it is to be installed. Accordingly, any dead space, shown hatched in FIG. 4, which is created around the heat-exchange element within the heat-exchanger unit and does not contribute to the heat-exchange process in the heat-exchanger unit, has a necessarily large proportion within the installation space.

As described above, the former conventional heat-exchange element needs the posts 6 and the screws to fasten them, and is manufactured by stacking the heat-exchange components 5 and then cutting them to a desired shape. The heat-exchange plates 2 and the corrugated fins 3 have to be bonded firmly to each other. Therefore, the number of parts of the former conventional heat-exchange element is relatively large, and the process of manufacturing the former conventional heat-exchange element comprises a relatively large number of steps. Furthermore, actual products of the former conventional heat-exchange element tend to vary in quality.

Since the fluid passages 4, which are defined by the heat-exchange plates 2 and the corrugated fins 3, have a relatively small cross-sectional area, the flow of air through the fluid passages 4 suffers a large pressure loss. The corrugated fins 3, which have a low heat-exchange efficiency, are bonded to the heat-exchange plates 2 at many spots, preventing the heat-exchange plates 2 from being effectively utilized for heat exchange. In addition, the fluid passages 4 have inner wall surfaces which are so smooth that a temperature boundary layer is likely to develop easily, resulting in a reduction in the heat-exchange efficiency.

The latter conventional heat-exchange element is also made up of a relatively large number of parts and manufactured in a process comprising relatively large number of steps because it is necessary to firmly bond the heat-exchange components and The partitions to each other for a high sealing capability. The latter conventional heat-exchange element fails to prevent reduction in heat-exchange efficiency due to the development of a temperature boundary layer.

SUMMARY OF THE INVENTION

It is therefore an object of the present invention to provide a heat-exchange element which minimizes the proportion of a dead space created within an installation space for installing the heat-exchange element in a heat-exchanger unit for thereby utilizing the space within the heat-exchanger unit more effectively; can easily be manufactured; and is effective to transfer heat between fluids flowing in the heat-exchange element with a relatively high heat-exchange efficiency.

According to the present invention, there is provided a heat-exchange element comprising a plurality of heat-exchange components each having a circular heat-exchange plate, the circular heat-exchange plate having a plurality of ribs projecting from a surface thereof and extending generally in one direction, the circular heat-exchange plate having an outer circumferential edge thereof divided into four substantially equal edge portions, and including a pair of sealing ribs extending respectively along two diametrically opposite ones of the edges substantially parallel to the ribs, and a pair of end walls extending respectively along two other diametrically opposite ones of the edges substantially transversely to the ribs, the heat-exchange components being stacked into a cylindrical shape in which the end wails of each of the circular heat-exchange plates fittingly engage the sealing ribs an adjacent circular heat-exchange plates.

The circular heat-exchange plate, the ribs, the sealing ribs, and the end walls of each of the heat-exchange components are integrally molded of synthetic resin.

The end walls are positioned radially outwardly of the sealing ribs which are engaged by the end walls, the end walls have arcuate outer surfaces.

Each of the ribs has a plurality of teeth projecting laterally from a side thereof.

The circular heat-exchange plate has a plurality of bosses projecting from at least one surface thereof.

Each of the ribs has opposite smooth arcuate ends.

When the heat-exchange components are stacked with the end walls held in fitting engagement with the sealing ribs, the ribs define fluid passages between the circular heat-exchange plates. The fluid passages in one layer between two adjacent circular heat-exchange plates are oriented perpendicularly to the fluid passages in another layer between other two adjacent circular heat-exchange plates. The cylindrical assembly of the heat-exchange components effectively utilizes an installation space in a heat-exchanger unit in which the heat-exchange element is installed.

Since the circular heat-exchange plate, the ribs, the sealing ribs, and the end walls of each of the heat-exchange components are integrally molded of synthetic resin, and the heat-exchange components are stacked, the heat-exchange element can be manufactured easily with uniform product quality.

Because the end walls are positioned radially outwardly of the sealing ribs which are engaged by the end walls, the end walls have arcuate outer surfaces, any pressure loss caused by he outer surfaces of the end walls is reduced.

The teeth or unevenness projecting laterally from the ribs and the bosses or unevenness projecting from at least one surface of each of the heat-exchange plates positively disturb a fluid to produce turbulent vortexes in the fluid when the fluid flows through fluid passages defined by the ribs between the heat-exchange plates. Therefore, the heat-exchange element can transfer heat between fluids flowing therethrough with an increased heat-exchange efficiency.

Each of the ribs has smooth arcuate ends which are effective to reduce any pressure loss caused thereby.

According to the present invention, there is also provided a heat-exchange element comprising a cylindrical stack of heat-exchange components having respective circular heat-exchange plates, each of the circular heat-exchange plate having a plurality of ribs projecting from a surface thereof and extending generally in one direction, the circular heat-exchange plate having an outer circumferential edge thereof divided into four substantially equal edges, and including a pair of sealing ribs extending respectively along two diametrically opposite ones of the edges substantially parallel to the ribs, and a pair of end walls extending respectively along two other diametrically opposite ones of the edges substantially transversely to the ribs and held in fitting engagement with the sealing ribs of another circular heat-exchange plate, the ribs defining a plurality of fluid passages between adjacent two of the circular heat-exchange plates, the heat-exchange components being angularly oriented with respect to each other such that the fluid passages defined between adjacent two of the circular heat-exchange plates are directed substantially at a right angle to the fluid passages defined between adjacent circular heat-exchange plates.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 5:
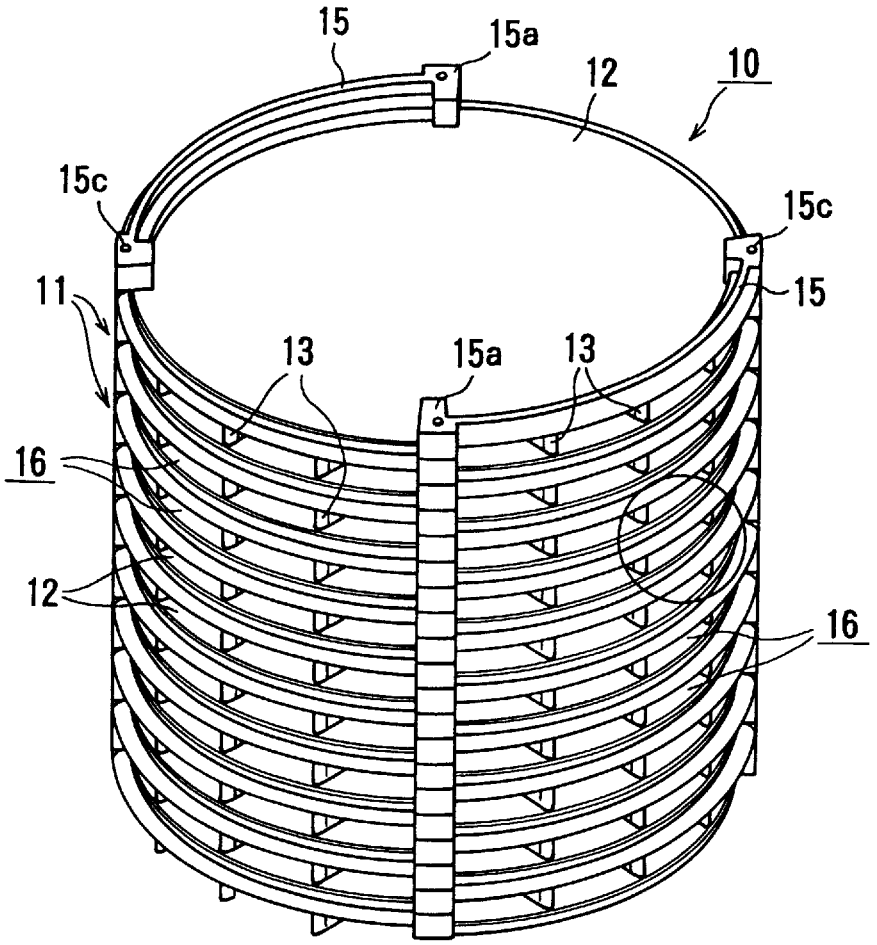
FIG. 5 is a perspective view of the heat-exchange element which is assembled according to the present invention.

As shown in FIG. 5, a heat-exchange element 10 according to the present invention comprises a plurality of stacked heat-exchange components 11 each integrally molded of synthetic resin. Adjacent ones of the heat-exchange components 11 are oriented alternately at right angles with respect to each other.

Figure 6:
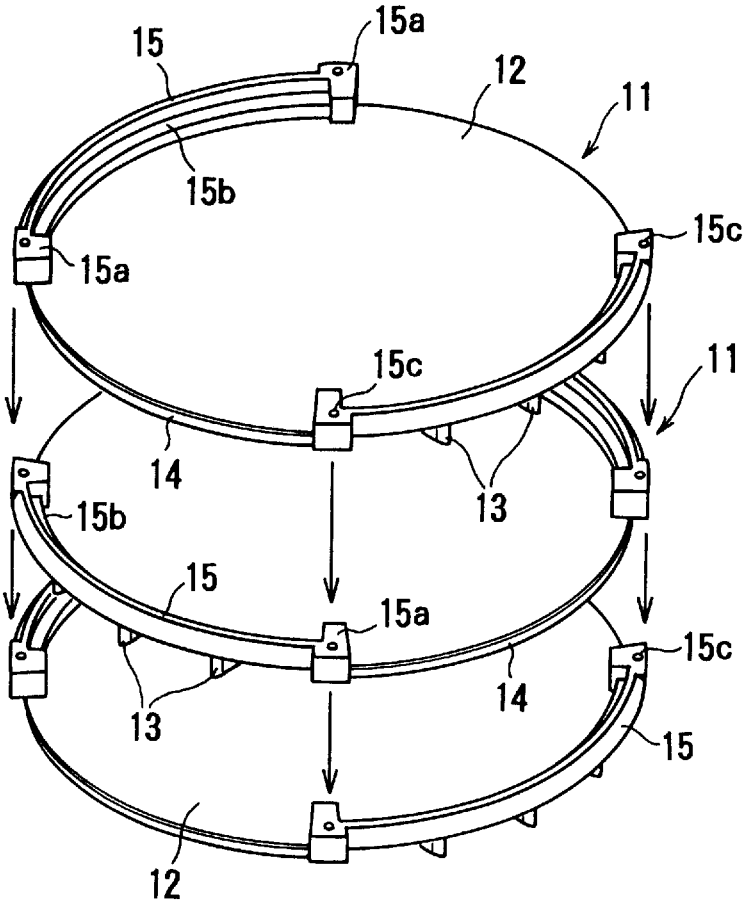
FIG. 6 is an exploded perspective view of a heat-exchange element according to the present invention.
Figure 7:
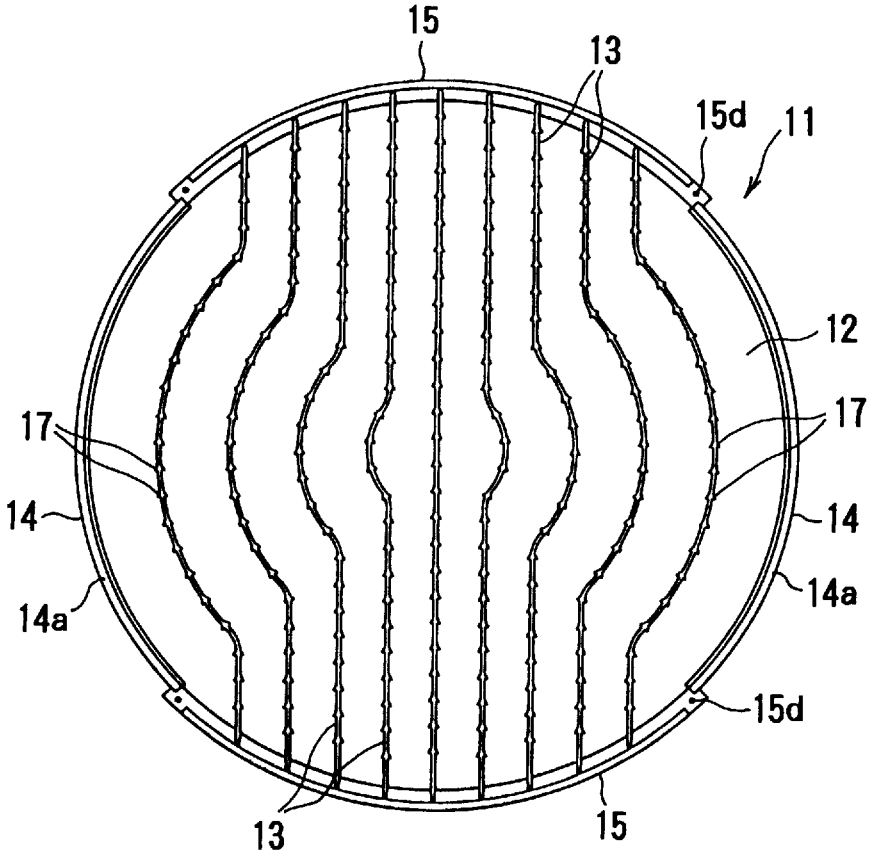
FIG. 7 is a, bottom view of a heat-exchange plate of the eat-exchange element.

As shown in FIGS. 6 and 7, each of the heat-exchange components 11 comprises a circular heat-exchange plate 12 having a plurality of ribs 13 projecting downwardly from a reverse side thereof and extending generally in one direction. Specifically, as shown in FIG. 7, the central rib 13 extends straight entirely diametrically across the circular heat-exchange plate 12, and each of the other ribs 13 extends straight at opposite ends thereof and concentrically with the circular heat-exchange plate 12 at a central region thereof. The circular heat-exchange plate 12 has its outer circumferential edge divided into four substantially equal arcuate edges. The circular heat-exchange plate 12 also has a pair of arcuate sealing ribs 14 extending respectively along two diametrically opposite ones of the four equal arcuate edges thereof substantially parallel to the ribs 13. The arcuate sealing ribs 14 project downwardly from the reverse side of the circular heat-exchange plate 12.

The central regions of the ribs 13 are not limited to the illustrated shape which is concentric with circular heat-exchange plate 12. Rather, the ribs 13 may be arranged in an arbitrary pattern which reduces the resistance to a fluid flowing between the ribs 13 and increases a heat-exchange efficiency.

All of the ribs 13 and the sealing ribs 14 have a uniform height of 2 mm, for example, from the reverse side of the heat-exchange plate 12.

The circular heat-exchange plate 12 also has a pair of arcuate end walls 15 extending respectively along two other diametrically opposite ones of the four equal arcuate edges thereof substantially transversely to the ribs 13. The arcuate end walls 15 project upwardly from a face side thereof remotely from the ribs 13 and have a height which is the same as the height of the ribs 13. Each of the arcuate end walls 15 has a pair of blocks 15*a* on its opposite ends and an arcuate engaging recess 15*b* defined in a radially inner surface thereof between the blocks 15*a* and having a length which is the same as the length of one of the sealing ribs 14.

Each of the sealing ribs 14 has an arcuate recess 14*a* defined in a radially outer surface thereof. The arcuate engaging recess 15*b* of each of the arcuate end walls 15 has a transverse cross-sectional shape which is complementary to the transverse cross-sectional shape of one of the sealing ribs 14.

When the heat-exchange components 11 are vertically stacked in alternately 90°-spaced orientations, the sealing ribs 14 of an upper heat-exchange component 11 are fitted in the respective arcuate engaging recesses 15*b* of a lower heat-exchange component 11. Because the sealing ribs 14 are complementarily intimately received in the arcuate engaging recesses 15*b* fully along their length and height, the sealing ribs 14 and the arcuate end walls 15 are intimately combined with each other to provide a sufficient sealing capability. When the sealing ribs 14 are fitted in the arcuate engaging recesses 15*b*, the arcuate end walls 15 are positioned radially outwardly of the sealing ribs 14.

Figure 8:
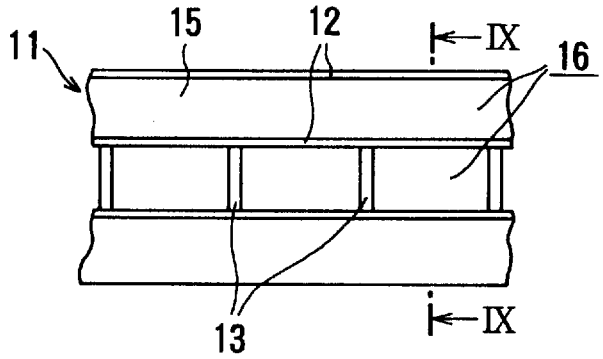
FIG. 8 is an enlarged fragmentary front elevational view of the heat-exchange element shown in FIG. 6.
Figure 9:
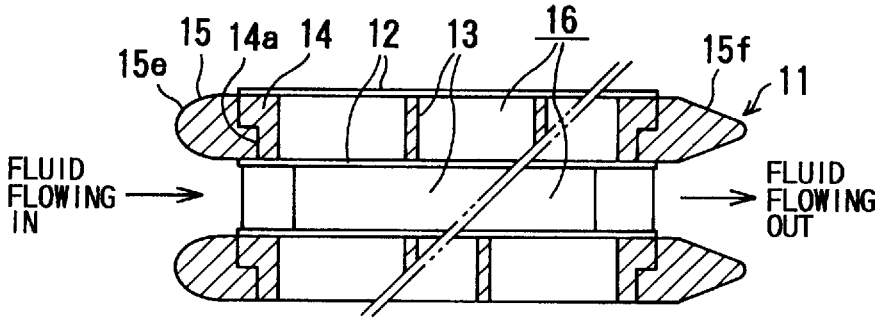
FIG. 9 is a cross-sectional view taken along line IX—IX of FIG. 8.

The heat-exchange components 11 thus stacked in alternately 90°-spaced orientations jointly make up the heat-exchange element 10 which is of a cylindrical shape that has a plurality of stacked layers of fluid passages 16 extending in alternately 90°-spaced directions, as shown in FIGS. 8 and 9. Specifically, a layer of fluid passages 16 is defined by the ribs 13 between a pair of stacked circular heat-exchange plates 12, and an adjacent layer of fluid passages 16, which are 90°-spaced from the layer of fluid passages 16, is defined by the ribs 13 between an adjacent pair of stacked circular heat-exchange plates 12. The heat-exchange components 11 can easily be assembled together in a sealed structure because the sealing ribs 14 and the arcuate end walls 15 can instantly be combined into interfitting engagement with each other. Therefore, the heat-exchange element 10 can be assembled highly efficiently.

When the heat-exchange components 11 are stacked, the blocks 15*a* of the arcuate end walls 15 are aligned with each other. Each of the blocks 15*a* has a cylindrical pin 15*c* projecting upwardly from an upper surface thereof and a cylindrical hole 15*d* defined in a lower surface thereof. With the heat-exchange components 11 stacked, the cylindrical pin 15*c* of each of the blocks 15*a* of a lower heat-exchange component 11 is fitted in the cylindrical hole 15*d* of one of the blocks 15*a* of an upper heat-exchange component 11. Therefore, the cylindrical pins 15*c* and the cylindrical holes 15*d* jointly serve to position the heat-exchange components 11 with respect to each other in hermetically sealed engagement.

Figure 10:
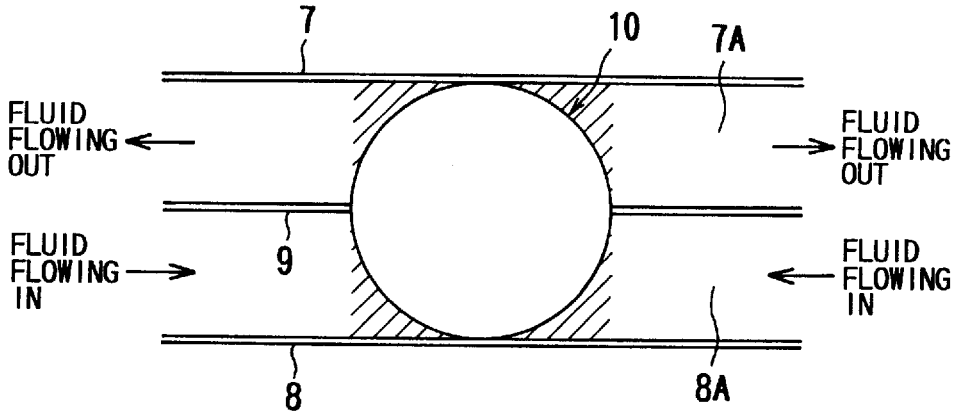
FIG. 10 is a cross-sectional view of a heat-exchanger unit which incorporates the heat-exchange element according to the present invention.

As shown in FIG. 10, the heat-exchange element 10 is assembled in a heat-exchanger unit which has an upper panel 7, a lower panel 8, and a partition 9 disposed intermediate between the upper and lower panels 7, 8. The upper and lower panels 7, 8 and the partition 9 jointly define upper and lower fluid passages 7A, 8A. The heat-exchange element 10 is positioned between the upper and lower panels 7, 8 across the partition 9 transversely to the upper and lower fluid passages 7A, 8A, with the fluid passages 16 in the alternate layers extending in diagonally crossing relation between the upper and lower fluid passages 7A, 8A. Exterior air flowing from the lower fluid passage 8A is introduced through the heat-exchange element 10 and the upper fluid passage 7A into a room, and interior air flows from the room through the lower fluid passage 8A into the heat-exchange element 10 and then through the upper fluid passage 7A into the atmosphere outside of the room.

Since the cylindrical heat-exchange element 10 is assembled in the heat-exchanger unit, any dead space, shown hatched in FIG. 10, which is created around the heat-exchange element 10 within the heat-exchanger unit and does not contribute to the heat-exchange process in the heat-exchanger unit, has a relatively small proportion within the installation space. As a consequence, the installation space for installing the heat-exchange element 10 in the heat-exchanger unit is effectively utilized, so that the heat-exchanger unit may be reduced in size and weight.

Figure 1:
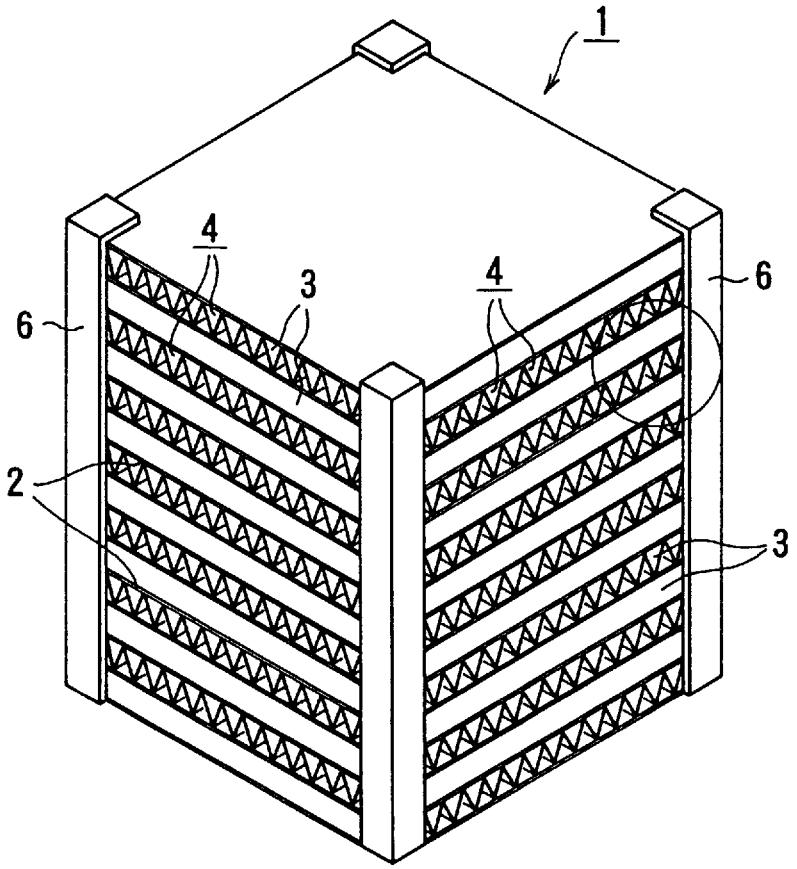
F I G. 1 PRIOR ART
FIG. 1 is a perspective view of a conventional heat-exchange element.
Figure 2:
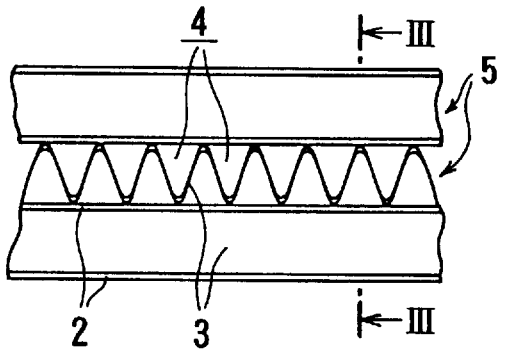
FIG. 2 PRIOR ART
FIG. 2 is an enlarged fragmentary front elevational view of the conventional heat-exchange element shown in FIG. 1.
Figure 3:
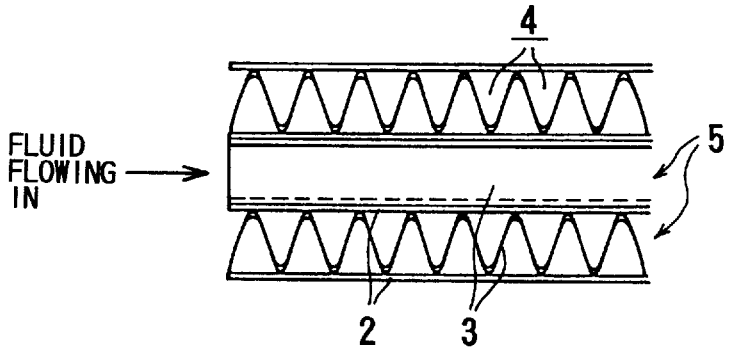
FIG. 3 PRIOR ART
FIG. 3 is a cross-sectional view taken along line III—III of FIG. 2.
Figure 4:
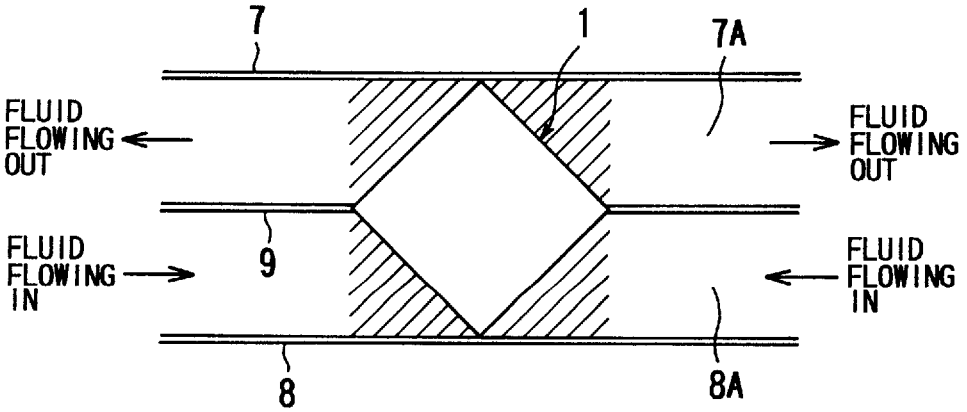
FIG. 4 PRIOR ART
FIG. 4 is a cross-sectional view of a heat-exchanger unit which incorporates the conventional heat-exchange element shown in FIG. 1.

The cylindrical heat-exchange element 10 has a heat transfer area which is about 1.5 to 1.6 times the heat transfer area of the conventional heat-exchange element 1 which has a rectangular transverse cross-sectional shape as shown in FIG. 4.

Each of the fluid passages 16 is defined by a pair of adjacent ribs 13 and a pair of upper and lower heat-exchange plates 11, and has inlet and outlet ports defined between the ribs 13 and the end walls 15 of upper and lower heat-exchange plates 11.

Specifically, as shown in FIG. 9, the end walls 15 which are positioned at the inlet port of the fluid passage 16 have respective round arcuate surfaces 15*e*, and the end walls 15 which are positioned at the outlet port of the fluid passage 16 have respective tapered arcuate surfaces 15*f*.

Figure 11:
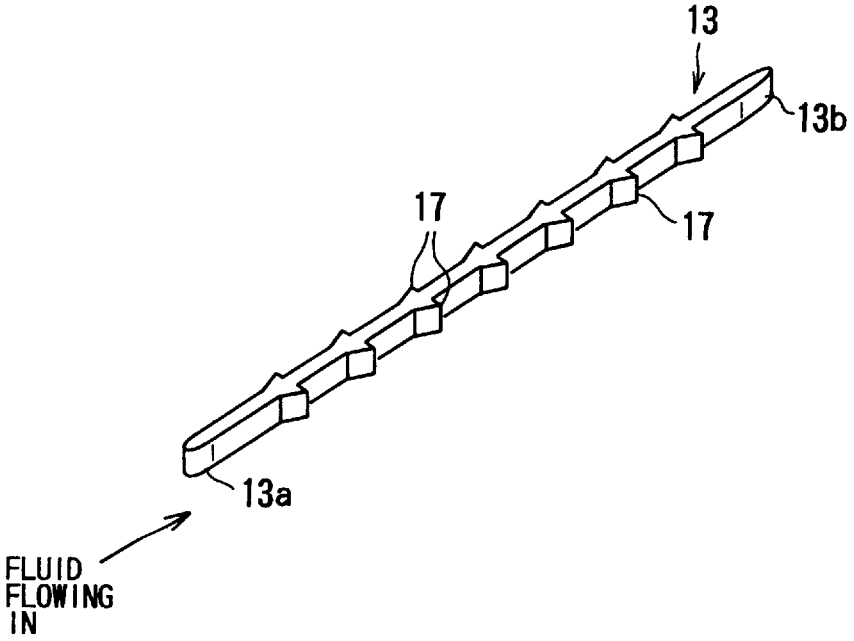
FIG. 11 is an enlarged perspective view of a rib of the heat-exchange element according to the present invention.

As shown in FIG. 11, each of the ribs 13 has a smooth round arcuate end 13*a* positioned at the inlet port of the fluid passage 16, and a smooth tapered arcuate end 13*b* positioned at the outlet port of the fluid passage 16. The round arcuate end 13*a* and the tapered arcuate end 13*b* should preferably have its surface defined by a cubic function for minimizing a pressure loss caused by the arcuate ends 13*a*, 13*b*.

Because of the arcuate surfaces 15*e*, 15*f* and the arcuate ends 13*a*, 13*b*, each of the inlet and outlet ports of each of the fluid passages 16 is vertically and horizontally spread to reduce any pressure loss caused thereby for allowing air to flow smoothly into and out of the fluid passage 16. Heat is transferred between the air introduced into the room and the air discharged from the room while they are flowing through the fluid passages 16.

As shown in FIG. 11, each of the ribs 13 has a plurality of pairs of arrow-shaped teeth 17 projecting integrally laterally from opposite sides thereof. The pairs of arrow-shaped teeth 17 are spaced at a pitch or interval of 2~40 mm, for example, longitudinally along the rib 13, and the arrow-shaped teeth 17 in each pair are aligned with each other transversely across the rib 13.

Figure 12:
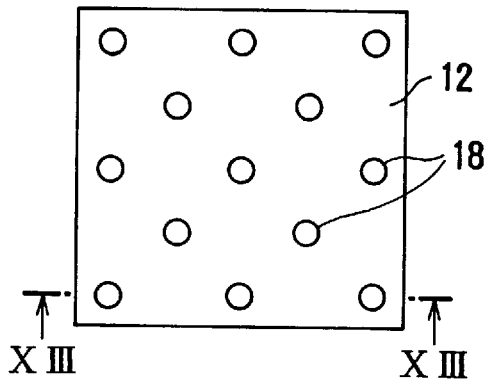
FIG. 12 is a fragmentary plan view of the heat-exchange plate.
Figure 13:
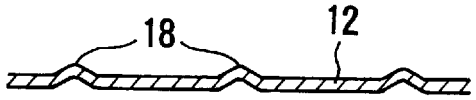
FIG. 13 is a cross-sectional view taken along line XIII—XIII of FIG. 12.

As fragmentarily shown in FIGS. 12 and 13, each of the heat-exchange plates 12 has a plurality of circular bosses 18 arranged in a staggered pattern and equally spaced at a pitch or interval of 2~40 mm, for example. The circular bosses 18 project upwardly from an upper surface of the heat-exchange plate 12 by a distance ranging from about 0.1 to 1.5 mm, for example.

The circular bosses 18 may be formed by pressing each of the heat-exchange plates 12 with a die having complementary bosses. However, the circular bosses 18 may be formed on the heat-exchange plates 12 when the heat-exchange components 11 are integrally molded of synthetic resin.

Figure 14:
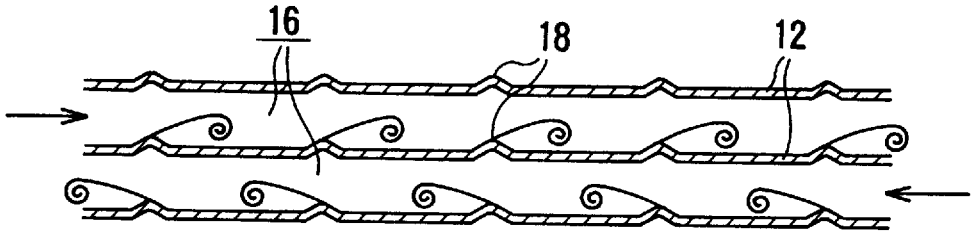
FIG. 14 is a fragmentary cross-sectional view illustrative of the manner in which the heat-exchange plate shown in FIGS. 12 and 13 operates.

When the heat-exchange element 10 is in use, the arrow-shaped teeth 17 of the ribs 13 positively disturb the air flow through the fluid passages 16 for thereby producing horizontal turbulent vortexes therein, and the circular bosses 18 of the heat-exchange plates 12 positively disturb the air flow through the fluid passages 16 for thereby producing vertical turbulent vortexes therein, as shown in FIG. 14. These turbulent vortexes are effective to increase the heat-exchange efficiency with which heat is transferred between the incoming and outgoing air flows in the heat-exchange element 10.

Figure 15:
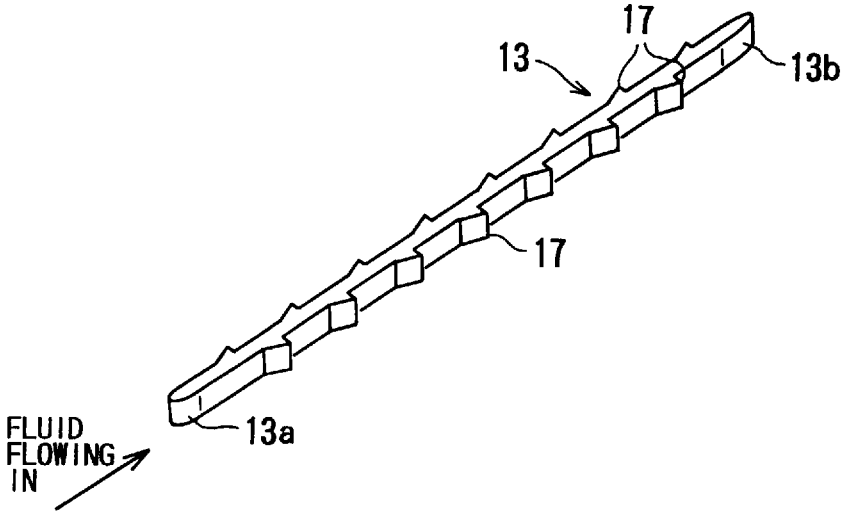
FIG. 15 is an enlarged perspective view of a modified rib.

As shown in FIG. 15, each of the ribs 13 may have a plurality of longitudinally staggered teeth 17 spaced at an interval along the rib 13. The teeth 17 on the opposite sides of the rib 13 are not aligned with each other. The longitudinally staggered teeth 17 reduces the development of vortexes in the air flows through the fluid passages 16 for thereby reducing any pressure loss caused in the air flows.

Each of the teeth 17 may be of any desired cross-sectional shape such as a semicircular shape, a triangular shape, a rectangular shape, a cylindrical shape, or a conical shape, or may be in the form of any desired shape such as a triangular prism, a triangular pyramid, a rectangular prism, a rectangular pyramid, a wing shape, etc.

Figure 16:
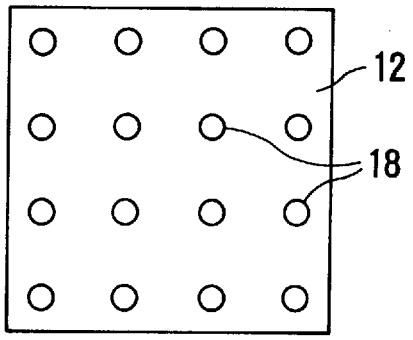
FIG. 16 is a fragmentary plan view of a modified heat-exchange plate.

As shown in FIG. 16, each of the heat-exchange plates 12 may have a plurality of circular bosses 18 arranged in a grid pattern.

Figure 17:
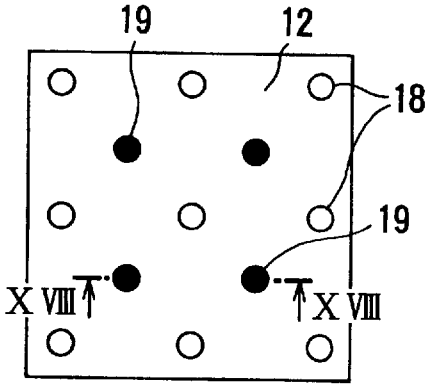
FIG. 17 is a fragmentary plan view of another modified heat-exchange plate.
Figure 18:
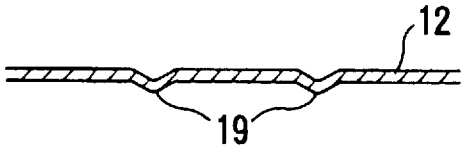
FIG. 18 is a cross-sectional view taken along line XVIII—XVIII of FIG. 17.
Figure 19:
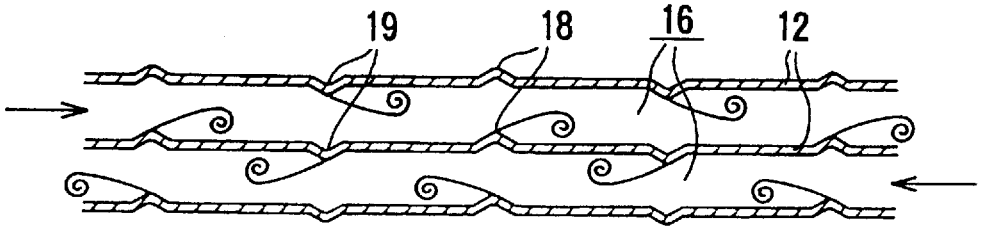
FIG. 19 is a fragmentary cross-sectional view illustrative of the manner in which the heat-exchange plate shown in FIGS. 17 and 18 operates.

As shown in FIGS. 17 and 18, each of the heat-exchange plates 12 may have a plurality of circular bosses 18 and a plurality of circular recesses 19 which are arranged in a staggered pattern, and the bosses 18 and the recesses 19 may alternate each other in diagonal directions. The bosses 18 and the recesses 19 are effective to produce vortexes along upper and lower surfaces of the fluid passages 16 as shown in FIG. 19.

Figure 20:
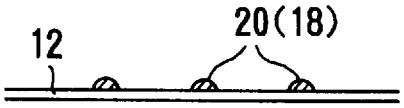
FIG. 20 is a cross-sectional view of still another modified heat-exchange plate.

As shown in FIG. 20, each of the bosses 18 may comprise a body 20 of a hotmelt synthetic resin which has been dropped onto an upper surface of the heat-exchange plate 2 in a molten state.

Figure 21:
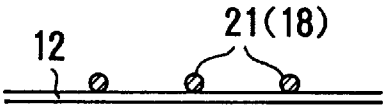
FIG. 21 is a cross-sectional view of yet still another modified heat-exchange plate.

Alternatively, as shown in FIG. 21, each of the bosses 18 may comprise a particulate solid body 21 bonded to an upper surface of the heat-exchange plate 2 by an adhesive.

The height, pattern, combination, and/or shape of the bosses 18, the recesses 19, and the teeth 17 may be changed as desired to vary the pressure loss and the heat-exchange efficiency of the heat-exchange element 10.

Although certain preferred embodiments of the present invention have been shown and described in detail, it should be understood that various changes and modifications may be made therein without departing from the scope of the appended claims.

What is claimed is:

1. A heat-exchange element comprising:

a plurality of heat-exchange components each having a circular heat-exchange plate;

said circular heat-exchange plate having a plurality of ribs projecting from a surface thereof and extending in one direction, said circular heat-exchange plate having an outer circumferential edge thereof divided into four substantially equal edges, and including a pair of sealing ribs extending respectively along two diametrically opposite ones of said edges substantially parallel to said ribs, and a pair of end walls extending respectively along two other diametrically opposite ones of said edges substantially transversely to said ribs, said heat-exchange components being stacked into a cylindrical shape in which said end walls of each of the circular heat-exchange plates fittingly engage the sealing ribs of another one of the circular heat-exchange plates, and wherein said end walls are positioned radially outwardly of said sealing ribs which are engaged by said end walls, said end walls having arcuate outer surfaces.

2. A heat-exchange element comprising:

a plurality of heat-exchange components each having a circular heat-exchange plate;

said circular heat-exchange plate having a plurality of ribs projecting from a surface thereof and extending in one direction, said circular heat-exchange plate having an outer circumferential edge thereof divided into four substantially equal edges, and including a pair of sealing ribs extending respectively along two diametrically opposite ones of said edges substantially parallel to said ribs, and a pair of end walls extending respectively along two other diametrically opposite ones of said edges substantially transversely to said ribs, said heat-exchange components being stacked into a cylindrical shape in which said end walls of each of the circular heat-exchange plates fittingly engage the sealing ribs of another one of the circular heat-exchange plates, and wherein each of said ribs has a plurality of teeth projecting laterally from a side thereof.

3. A heat-exchange element comprising:

a plurality of heat-exchange components each having a circular heat-exchange plate;

said circular heat-exchange plate having a plurality of ribs projecting from a surface thereof and extending in one direction, said circular heat-exchange plate having an outer circumferential edge thereof divided into four substantially equal edges, and including a pair of sealing ribs extending respectively along two diametrically opposite ones of said edges substantially parallel to said ribs, and a pair of end walls extending respectively along two other diametrically opposite ones of said edges substantially transversely to said ribs, said heat-exchange components being stacked into a cylindrical shape in which said end walls of each of the circular heat-exchange plates fittingly engage the sealing ribs of another one of the circular heat-exchange plates, and wherein said circular heat-exchange plate has a plurality of bosses projecting from at least one surface thereof and being disposed in vertically spaced relation from portions of an adjacent heat exchange plate.

* * * * *